United States Patent [19]

King et al.

[11] Patent Number: 4,696,354

[45] Date of Patent: Sep. 29, 1987

[54] DRILLING BIT WITH FULL RELEASE VOID AREAS

[75] Inventors: William W. King; Edmund C. Houle, Jr., both of Houston, Tex.

[73] Assignee: Hughes Tool Company - USA, Houston, Tex.

[21] Appl. No.: 880,214

[22] Filed: Jun. 30, 1986

[51] Int. Cl.[4] ..... E21B 10/60

[52] U.S. Cl. ..... 175/329; 175/393

[58] Field of Search ..... 175/393, 339, 329, 340, 175/417, 385, 400

[56] References Cited

U.S. PATENT DOCUMENTS

| | | | |
|---|---|---|---|
| 2,371,489 | 3/1945 | Williams, Jr. | 175/329 |
| 2,931,630 | 4/1960 | Grady | 175/400 |
| 3,112,803 | 12/1963 | Rowley | 175/393 |
| 3,548,959 | 12/1970 | Hasiba | 175/393 |
| 3,559,736 | 8/1971 | Thompson | 175/329 |
| 4,116,289 | 9/1978 | Feenstra | 175/329 |
| 4,360,069 | 11/1982 | Davis | 175/393 |
| 4,505,342 | 5/1985 | Barr et al. | 175/329 |
| 4,515,227 | 5/1985 | Cerkovnik | 175/393 |
| 4,550,790 | 11/1985 | Link | 175/329 |
| 4,554,986 | 11/1985 | Jones | 175/329 |

*Primary Examiner*—Stephen J. Novosad
*Assistant Examiner*—Bruce M. Kisliuk
*Attorney, Agent, or Firm*—Charles D. Gunter, Jr.

[57] ABSTRACT

A bit is shown for use in drilling earthen formations which includes a body having a bit face on one end and a shank on the opposite end which is connected in the drill string. The bit body has a tubular bore which communicates with an interior bore of the drill string for circulation of fluids. The bit face increases in external diameter between a nose and a gage region of the bit. A fluid opening communicates the bit face with the tubular bore for circulating fluid to the bit face. A plurality of fluid courses are disposed on the bit body, the fluid courses becoming ever wider and ever deeper along their entire disposition from their lowermost incorporation through the gage region thereof.

6 Claims, 5 Drawing Figures

FIG. 2
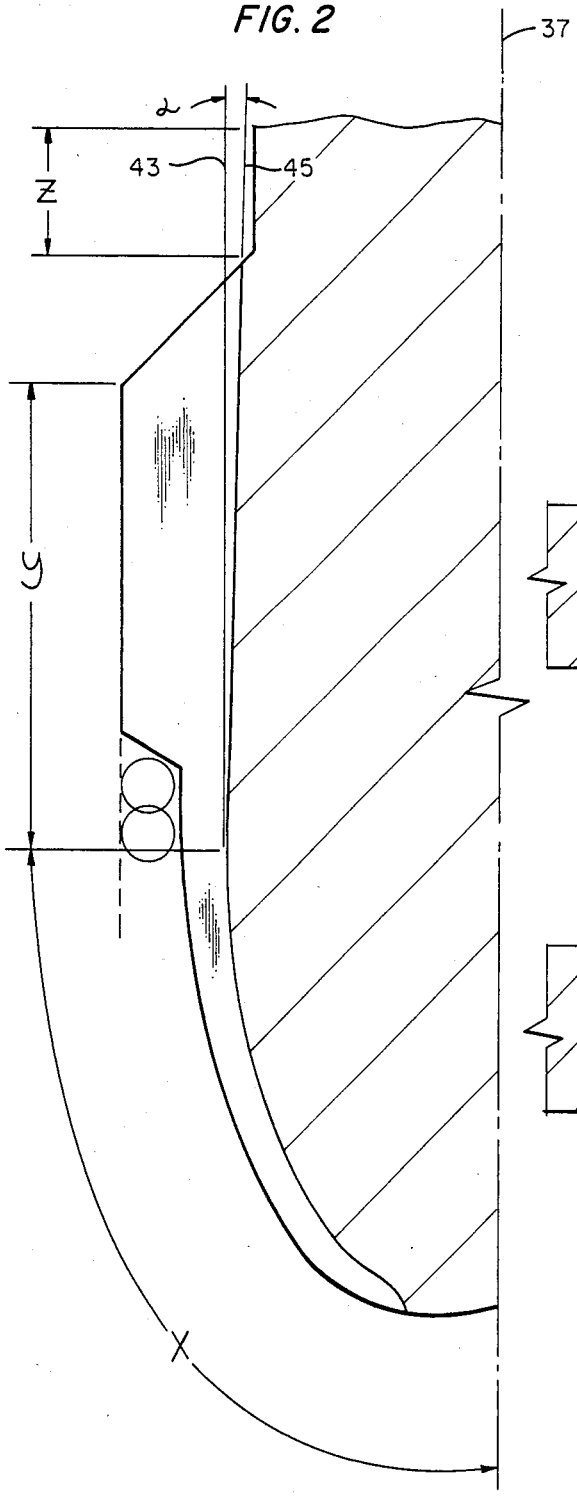
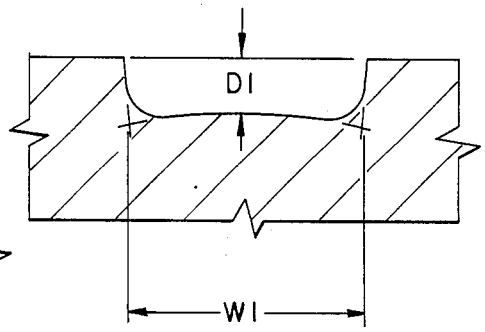
FIG. 5
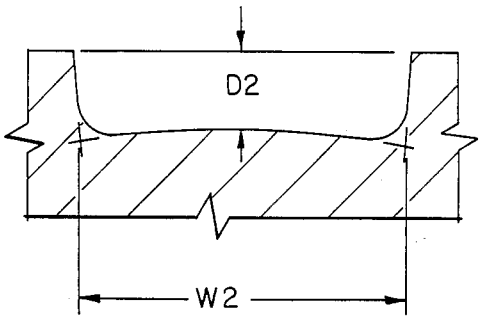
FIG. 4

DRILLING BIT WITH FULL RELEASE VOID AREAS

BACKGROUND OF THE INVENTION

1. Field of the Invention.

This invention relates in general to earth boring bits of the type used to drill oil and gas wells.

2. Description of the Prior Art.

Commercially available earth boring bits can be generally divided into the rolling cutter bits, having either steel teeth or tungsten carbide inserts, and diamond bits, which utilize either natural diamonds or artifical or man-made diamonds. The artificial diamonds are "polycrystalline," used either individually or as a component of a composite compact or insert on a cemented tungsten carbide substrate. Recently, a new artificial polycrystalline diamond has been developed which is stable at higher temperatures than the previously known polycrystalline diamond.

The diamond earth boring bits can be generally classified as either steel bodied bits or matrix bits. Steel body bits are machined from a steel block and typically have cutting elements which are press-fit into recesses provided in the bit face. The matrix bit is formed by coating a hollow tubular steel mandrel in a castin mold with metal bonded hard material, such as tungsten carbide. The casting mold is of a configuration which will give a bit of the desired form. The cutting elements are typically either polycrystalline diamond compact cutters brazed within a recess provided in the matrix backing or are thermally stable polycrystalline diamond or natural diamond cutters which are cast within recesses provided in the matrix backing.

The single piece bits, whether steel bodied or matrix, typically include a bit body with a tubular bore which communicates with the interior bore of the drill string for circulation of fluids. At least one fluid opening communicates the bit face with the tubular bore for circulating fluid to the bit face to carry off cuttings during drilling. A plurality of fluid courses, sometimes referred to as "void areas" or "junk slots" allow the flow of drilling fluid and formation cuttings from the bit face up the bore hole annulus.

In the past, these void areas or fluid courses have tended to be of uniform width and depth, particularly in the gage region of the bit body and have tended to become packed off by cuttings in certain formations. As a result, the bit penetration rate dropped.

SUMMARY OF THE INVENTION

A bit is shown for use in drilling earthen formations which includes a body having a bit face on one end and a shank on the opposite end with means for connection to a drill string for rotation about a longitudinal axis. The bit body has a tubular bore which communicates with an interior bore of the drill string for circulation of fluids. The bit face increases in external diameter between a nose and a gage region of the bit. At least one fluid opening communicates the bit face with the tubular bore for circulating fluid to the bit face. A plurality of fluid courses disposed on the bit face extend through the gage region of the bit. The fluid courses become ever wider and ever deeper along their entire disposition.

Additional objects, features and advantages will be apparent in the written description which follows.

BRIEF DESCRIPTION OF THE DRAWINGS

FIG. 2 is a simplified, schematic view of the bit of FIG. 1 showing the ever deepening nature of the fluid course.

FIG. 4 is a partial, sectional view taken along lines B—B′ in FIG. 3.

FIG. 5 is a partial, sectional view taken along lines A—A′ in FIG. 3.

DETAILED DESCRIPTION OF THE INVENTION

Figure 1:
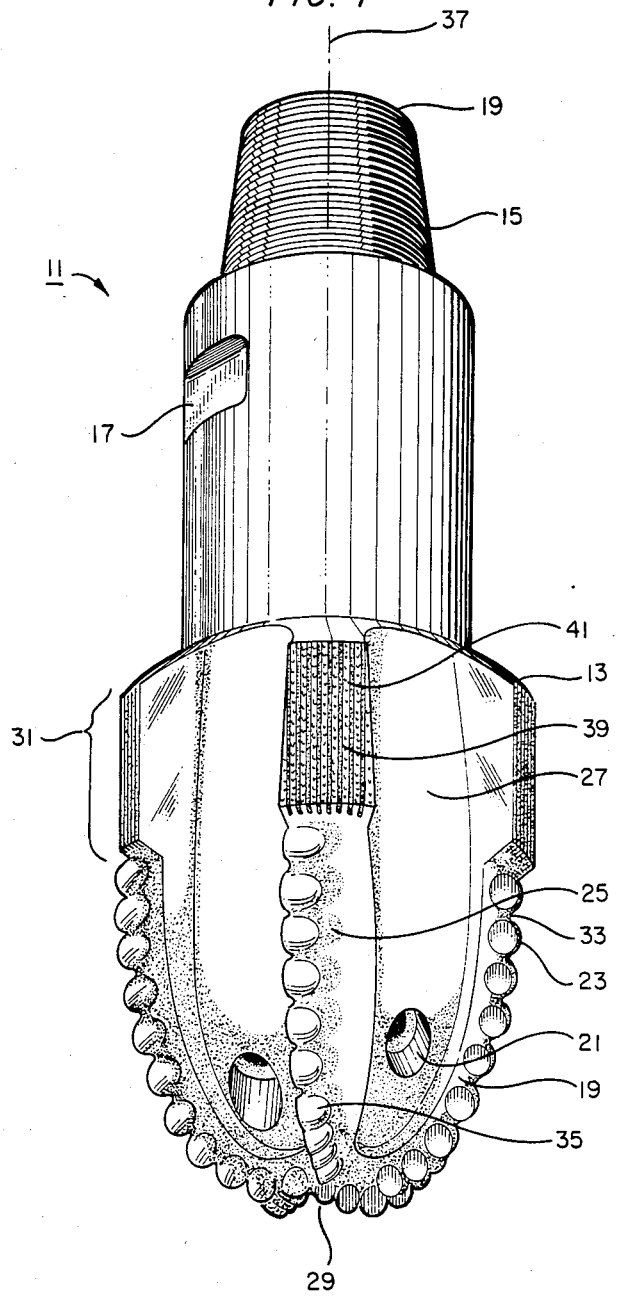
FIG. 1 is a perspective view of a bit of the invention showing the ever widening and deepening fluid courses on the bit body.

The numeral 11 in the drawing designates an earth boring bit having a body 13 with a threaded shank 15 formed on one end for connection with a drill string member (not shown). The body 13 further includes a pair of wrench flats 17 used to apply the appropriate torque to properly "make-up" the threaded shank 15. The body 13 has a tubular bore 19 which communicates with the interior of the drill string member, and which communicates by internal fluid passageways (not shown) with one or more fluid openings 21 which are used to circulate fluids to the bit face.

On the opposite end of the bit body 13 from the threaded shank 15, there is formed a bit head or "matrix" 19 in a predetermined configuration to include cutting elements 23, longitudinally extending lands 25, and fluid courses or void areas 27. The matrix 19 is of a composition of the same type used in conventional diamond matrix bits, one example being that which is disclosed in U.S. Pat. No. 3,175,629 to David S. Rowley, issued Mar. 30, 1965. Such matrices can be, for example, formed of copper-nickel alloy containing powdered tungsten carbide.

Matrix head bits of the type under consideration are manufactured by casting the matrix material in a mold about a steel mandrel. The mold is first fabricated from graphite stock by turning on a lathe and machining a negative of the desired bit profile. Cutter pockets are then milled in the interior of the mold to the proper contours and dressed to define the position and angle of the cutters. The fluid channels 27 and internal fluid passageways are formed by positioning a temporary displacement material within the interior of the mold which will later be removed.

A steel mandrel is then inserted into the interior of the mold and the tungsten carbide powders, binders and flux are added to the mold. The steel mandrel acts as a ductile core to which the matrix material adheres during the casting and cooling state. After firing the bit in a furnace, the mold is removed and the cutters are mounted on the exterior bit face within recesses in or receiving pockets of the matrix.

The bit body 13 in FIG. 1 has a ballistic or "bullet-shaped" profile which increases in external diameter between a nose 29 and a gage region 31 of the bit. Referring to FIG. 2, the face region extends generally along the region "X," the gage region extends generally along the region "Y" and the shank extends generally along the region "Z." The bit is generally conical in cross-section and converges from the gage region "Y" to the noze 29. By "gage" is meant the point at which the bit begins to cut the full diameter. That is, for an $8\frac{1}{2}$ inch diameter bit, this would be the location on the bit face at which the bit would cut an $8\frac{1}{2}$ inch diameter hole.

As shown inFIG. 1, each fluid course 27 comprises a groove of lesser relative external diameter located between two lands (25, 33 in FIG. 1) on the bit face. The lands 25, 33 have polycrystalline diamond cutter elements 23 mounted therein within backings of the matrix for drilling the earthen formations. The backings 35 for the cutting elements 23 are portions of the matrix which protrude outwardly from the face of the bit and which are formed with cutter receiving pockets or recesses during the casting operation.

The cutting elements 23 are of a hard material, preferably polycrystalline diamond composite compacts. Such cutting elements are formed by sintering a polycrystalline diamond layer to a tungsten carbide substrate and are commercially available to the drilling industry from General Electric Company under the "STRATAPAX" trademark. The compact is mounted in the recess provided in the matrix by brazing the compact within the recess. The preferred cutting elements 23 are generally cylindrical.

As shown in FIG. 1, each land 25, 33 is formed as a convex ridge of the matrix material which extends from the nose 29 outwardly in an arcuate path, the path gradually transitioning to extend generally longitudinally along the bit axis 37 to terminate in a planar pad 39 at the gage region 31 of the bit. The planar pads 39 have small diamonds (polycrystalline and/or natural) imbedded in the surface thereof and have longitudinal troughs which extend generally parallel to the longitudinal axis 37 of the bit.

The fluid courses 27 become ever wider and deeper through the gage region "y" of the bit where prior art bits were of constant width and depth. In the preferred embodiment shown in FIG. 1, the fluid courses 27 become ever wider and deeper along the face of the bit from the nose 29 through the gage region 31 to the shank region "Z" (FIG. 2). As illustrated in FIGS. 4–5, $D_2-D_1$ is always greater than 0, and $W_2-W_1$ is always greater than 0. Thus a normal plane drawn through any selected fluid course 27 at one incremental location (such as that illustrated in FIG. 5) along the bit face increases in cross-sectional area in the direction of the gage region 31 (as indicated in FIG. 4). The cross-sectional area of the normal plane decreases in increments in the direction of the nose 29.

The constantly deepening feature of the void area is illustrated in FIG. 2. Imaginary line 43 drawn parallel to the bit axis 37 represents the constant depth of a prior art bit in the gage region "Y". Imaginary line 45 is an extension of the actual depth of the fluid course 27 in the bit of the invention. The angle alpha formed between lines 43 and 45 is preferably in the range from about $\frac{1}{4}$ degree to about 7 degrees and most preferably is in the range from about 1 degree to 2.5 degrees.

Figure 3:
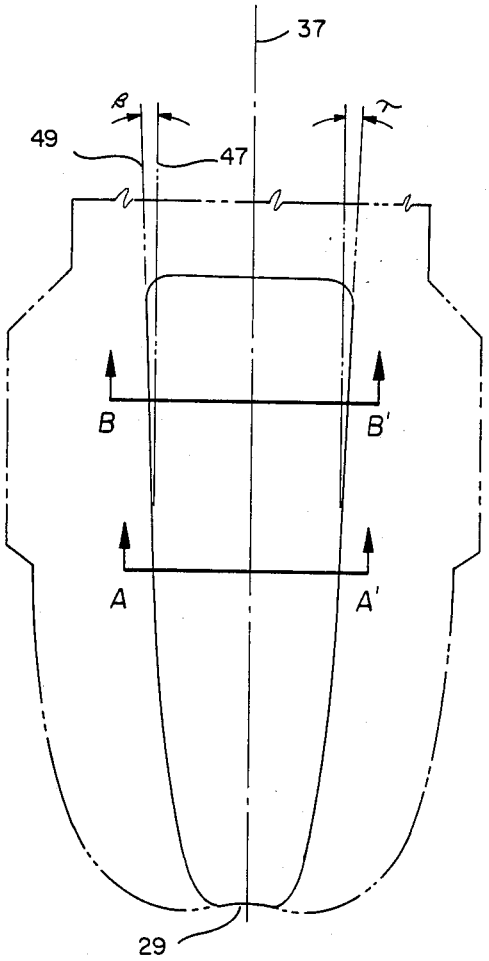
FIG. 3 is a simplified, schematic view of the bit of FIG. 1 showing the ever widening nature of the fluid course.

The constantly widening feature of the void area is illustrated in FIG. 3. Imaginary line 47 in FIG. 3 is parallel to a plane drawn through the bit axis 37 and corresponds to an edge of a constant width void area of a prior art bit in the gage region "Y." Imaginary line 49 is an extension of the fluid course 27 in the bit of the invention. The angle beta is in the range from about $\frac{1}{4}$ degree to 10 degrees, preferably in the range from about 2 degrees to 4 degrees, most preferably about 3 degrees on either side of the fluid course. That is, angle tau in FIG. 3 is equal to angle beta.

An invention has been provided with several advantages. The drilling bit of the invention features fluid courses which are ever widening and ever deepening from their lowermost and/or centermost disposition through the gage region of the bit. Because the void area is fully expanding, there is no choke point present which would tend to form a constriction for entrained cuttings in the drilling fluid. Any tendency of the fluid course to pack-off is eliminated because any differential movement of the obstruction moves the obstruction to a larger cross-sectional flow area to allow release. It is no longer necessary for the operator to run a special additive in the drilling fluid to strip off a packed formation or to back the drill string off the bottom of the hole in an attempt to blow the obstruction away with drilling fluid. In addition, the improved removal of cuttings allowed by a bit embodying the invention results in faster penetration rates and more economical drilling.

While the invention has been shown in only one of its forms, it is not thus limited but is susceptible to various changes and modifications without departing from the spirit thereof.

We claim:

1. A bit for use in drilling earthen formations, comprising:

a body including a bit face on one end and a shank on the opposite end with means for connection to a drill string for rotation about a longitudinal axis, the bit body having a tubular bore which communicates with an interior bore of the drill string for circulation of fluids, the bit face increasing in external diameter in the direction of the shank to form a gage region of the bit;

at least one fluid opening communicating the bit face with the tubular bore for circulating fluid to the bit face; and a plurality of fluid courses disposed on the exterior of the bit body and extending from a lowermost downhole location upwardly in the direction of the shank, the fluid courses becoming ever wider and ever deeper along their entire disposition from their lowermost incorporation through the gage region thereof.

2. A bit for use in drilling a hole downwardly in an earthen formation, comprising:

a body including a bit face on one end and a shank on the opposite end with means for connection to a drill string for rotation about a longitudinal axis, the bit body having a tubular bore which communicates with an interior bore of the drill string for circulation of fluids, the bit face increasing in external diameter between a nose and a gage region of the bit;

a plurality of fluid openings communicating the bit face with the tubular bore for circulating fluid to the bit face; and a plurality of fluid courses disposed on the exterior of the bit body and extending from a lowermost downhole location upwardly in the direction of the shank, each fluid course comprising a groove of lesser relative external diameter located between two lands of greater relative external diameter, the lands having cutter elements mounted therein for drilling the earthen formation, the fluid courses becoming ever wider and ever deeper along their entire disposition from their lowermost incorporation through the gage region thereof.

3. The bit of claim 2, wherein a normal plane drawn through a fluid course at one incremental location increases in cross-sectional area in the uphole direction and decreases in cross-sectional area in the downhole direction.

4. A matrix bit for use in drilling earthen formations, comprising:

a body including a bit face on one end formed from a cast matrix material bonded to a metallic shank on the opposite end with means for connection to a drill string for rotation about a longitudinal axis, the bit body having a tubular bore which communicates with an interior bore of the drill string for circulation of fluids, the bit face increasing the external diameter between a nose and a gage region of the bit;

a plurality of fluid openings communicating the bit face with the tubular bore for circulating fluid to the bit face;

a plurality of fluid courses on the bit face extending from the fluid openings, each fluid course comprising a groove of lesser relative external diameter located between two lands of greater relative external diameter on the bit body, the lands having polycrystalline diamond cutter elements mounted therein within backings of the matrix for drilling the earthen formation, the fluid courses becoming ever wider and ever deeper along the face of the bit from the nose through the gage region thereof.

5. The matrix bit of claim 4, wherein the face region of the bit is formed in a ballistic shape and wherein the lands begin as convex ridges extending from the nose and terminate in planar pads at the gage region.

6. The matrix bit of claim 5, wherein the lands begin at a central location on the bit face and extend outwardly and upwardly in the direction of the shank with each land being spaced circumferentially from the next adjacent land.

* * * * *